United States Patent [19]

Yajima

[11] Patent Number: 5,002,410

[45] Date of Patent: Mar. 26, 1991

[54] PRINTING APPARATUS

[75] Inventor: Hiroshi Yajima, Hamuramachi, Japan

[73] Assignee: Casio Computer Co., Ltd., Tokyo, Japan

[21] Appl. No.: 330,058

[22] Filed: Mar. 29, 1989

[30] Foreign Application Priority Data

Apr. 4, 1988 [JP] Japan ..... 63-1988[U]

[51] Int. Cl.[5] ..... B41J 3/36

[52] U.S. Cl. ..... 400/88; 400/120; 400/193

[58] Field of Search ..... 400/29, 88, 120, 193

[56] References Cited

U.S. PATENT DOCUMENTS 4,362,407 12/1982 Kolm ..... 400/124
4,750,049 6/1988 Murakami ..... 400/120
4,915,027 4/1990 Ishibashi ..... 400/120

FOREIGN PATENT DOCUMENTS 251157 10/1987 Japan ..... 400/120

*Primary Examiner*—David A. Wiecking
*Assistant Examiner*—Steven S. Kelley
*Attorney, Agent, or Firm*—Frishauf, Holtz, Goodman & Woodward

[57] ABSTRACT

In a manually sweeping type printing apparatus having a lighter weight than a force in printing, the printing operation is effected without applying any external depression load. The printing apparatus includes a thermal head a piezoelectric actuator which performs movements of expansion and contraction in synchronism with an alternating voltage, and means for coupling the thermal head to the piezoelectric actuator with maintaining vibrations. The piezoelectric acutator is manufactured by stacking a plurality of piezoelectric ceramic sheets, and stretched in an axial direction thereof upon receiving the alternating voltage. This deformation causes another vibration of the thermal head in the axial direction, whereby the force against the recording paper is obtained by the vibration of the thermal head. An average value "F" of the force "F" exerted by the thermal head against the recording paper is set not to be more than the weight of the printing apparatus. Also a maximum value of the force is selected to be more than a minimum value of the required force. As a consequence, although the weight of the printing apparatus is less than the force in printing, such a printing apparatus can be realized that more than the force required for thermally-transferring the heat transfer ink to the recording paper can be delivered.

7 Claims, 4 Drawing Sheets

FIG. 4
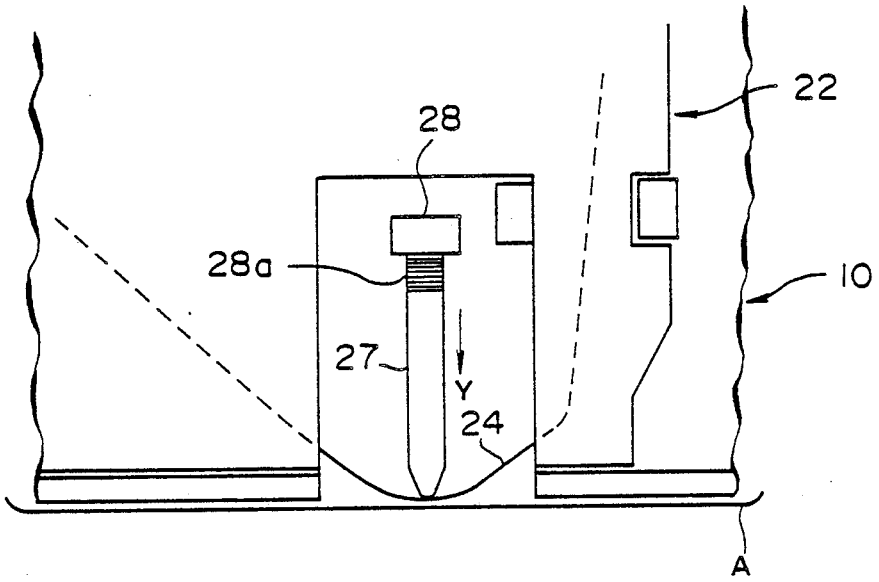
FIG. 5A
FIG. 5B
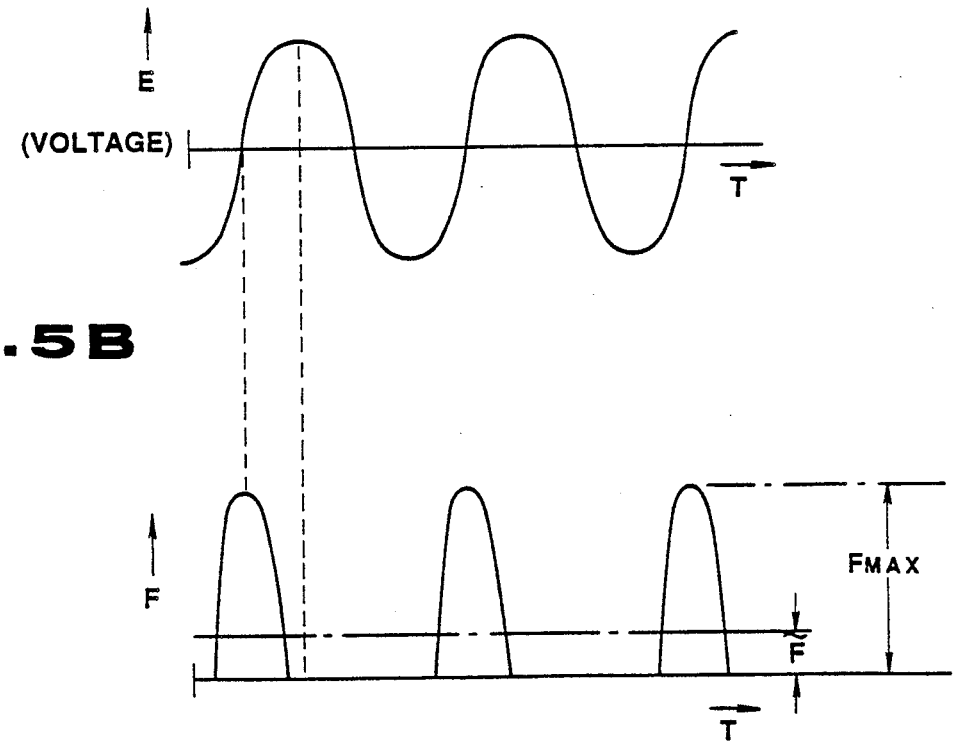

PRINTING APPARATUS

BACKGROUND OF THE INVENTION

1. Field of the Invention

The present invention relates to a force structure for a printing head of a printer such as a manually operable (sweeping type) handy printer.

2. Description of the Related Art

In general, a head transfer mode printer employing a line type thermal head has been equipped with a personal wordprocessor or a compact printer. In case that the thermal head having a width of, for instance, 40 millimeters is employed in such a compact handy printer, head force of several kilograms is required so as to transfer a heat transfer ink onto a recording surface of paper to be printed. Under these conditions, in a printer of, e.g., a personal wordprocessor where a thermal head is automatically pressed against a recording paper wound on a platen in order to perform a printing operation, a predetermined printing force can be set to the printing head.

However, there is such a problem in a manually sweeping type printer that the printer body must be pressed against the recording plane. This is the reason why the force is required for the printing operation. That is, generally speaking, a typical weight of the manually sweeping type printer is about 1 kg, which is lower than the printing force to be applied by the thermal head to the ink ribbon while heat-transferring the ink layer to the recording paper. As a consequence, the operation for continuously pressing the printer body against the recording paper at force higher than a predetermined value while moving the printer body, will cause a printer operator pain. When the lower force is given to the printer body, a poor printing quality is achieved. Even if too much force is applied to the printer body, various other problems may be caused.

As one problem, there is a higher risk that the printing apparatus is inclined with respect to the moving direction. Also as another problem, a fluctuation in the printer force to the recording paper may be produced, so that the driving operation of the ink ribbon interposed between the thermal head and recording paper is disturbed. In the normal trouble case, the ink ribbon is jammed on the thermal head, interrupting the printing operation. Furthermore, the need to apply the higher force against the recording paper causes the excess mechanical strength of the printing apparatus, and therefore the higher cost.

SUMMARY OF THE INVENTION

The present invention has been made in an attempt to solve the above-described problems of the conventional printing apparatus, and therefore has an object to provide a printing apparatus capable of obtaining a force required for the printing operation, with applying little force if any at all to the recording paper.

In a printing apparatus according to the invention, there are provided:

a printing apparatus comprising:

a thermal head having a large number of heating resistor elements arranged at predetermined pitches thereof;

an actuator being deformable in itself in such a manner as performing the movements of expansion and contraction in synchronism with an alternating voltage supplied thereto;

supporting means for supporting said actuator; and coupling means for coupling said thermal head with said actuator in such a manner that said movements of said actuator can be delivered to said thermal head;

whereby said thermal head generates vibrations, in response to said movements of said actuator, which causes a printing force against a recording paper.

BRIEF DESCRIPTION OF THE DRAWINGS

For a better understanding of the present invention, reference is made to the following description in conjunction with the accompanying drawings, in which:

FIG. 4 is a front view of the printing apparatus, for explaining the printing operation thereof;

FIG. 5A illustrates a characteristic graph between a time and a voltage applied to a piezoelectric actuator; and, FIG. 5B illustrates a characteristic graph between a time and a force produced by the vibration of the thermal head, applied to the recording paper.

DETAILED DESCRIPTION OF THE PREFERRED EMBODIMENTS

OVERALL PRINTING APPARATUS

Figure 2:
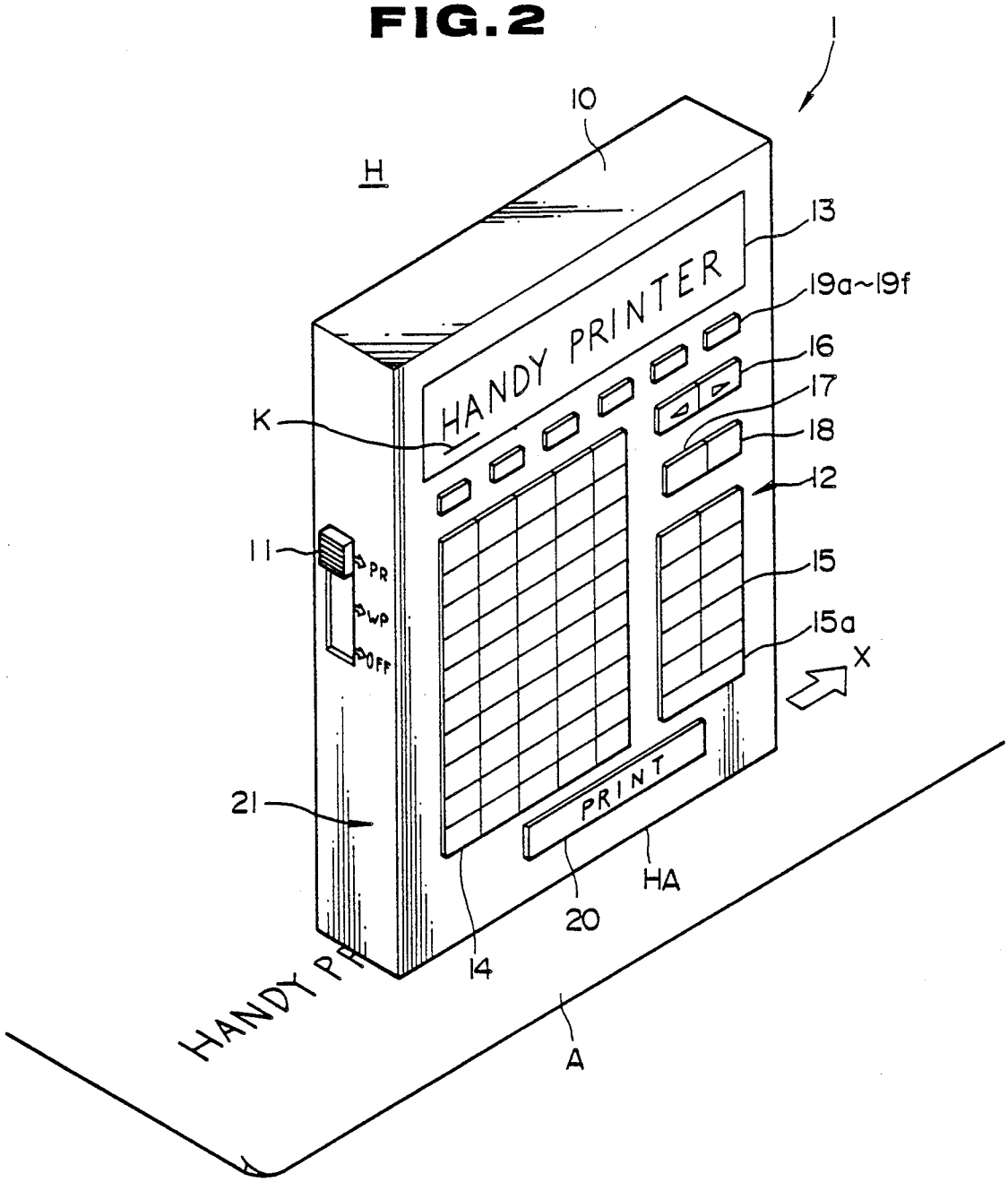
FIG. 2 is a perspective view of an overall printing apparatus shown in FIG. 1.

FIG. 2 is a perspective view of an overall printing apparatus 1 according to a preferred embodiment of the invention. Reference numeral 10 denotes a case. This case 10 is formed in such a size that it can be sufficiently handled by a user's hand. A mode changing switch 11 is provided on a left side of the printing apparatus 1. The function of this mode changing switch 11 is to both turn on/off a power supply, and change a wordprocessor mode, i.e., document forming mode "WP" and a printing mode "PR". When either wordprocessor mode "WP" or printing mode "PR" is designated, the power supply is turned on. A key input unit 12 and a display unit 13 are formed on a front side of the printing apparatus 1. In the key input unit 12, there are provided a character/symbol input key 14, a function key 15, a cursor key 16 and a print key 20. As the display unit 13, for instance, a dot-display type liquid crystal display device is employed. A printing head mechanism "HA" is mounted on a lower surface of the printing apparatus 1. This printing head mechanism "HA" includes a line type thermal head constructed of, for example, 48 dots per one line. The thermal head 27 has a large number of heating resistor elements **27*a*** which are arranged on the lower surface thereof at a predetermined interval.

The character/symbol input key 14 is used to enter alphanumeric characters and symbols. The function key 15 includes an execution key **15*a* for sectioning, for instance, the commencement and end of the document entry, or the designated removing range on the document entry; and various keys such as an insertion key, delete key, and shift key. Then, the characters and symbols entered by the character/symbol input key 14 and function key 15 are successively displayed on the above-described display unit 13. A cursor key 16** functions to move a cursor "K" in the horizontal direction on the display screen on which the document and symbol are also displayed. A designation of the input position and/or of the function range is made by moving this cursor "K".

The mode changing switch 1 is used to change the wordprocessor mode "WP" for forming the document into the print mode "PR" for printing out the formed document, and vice versa. In case of printing out the document formed by the key entry, after the print mode "PR" is designated by operating the mode changing switch 11, the forming surface of the heating resistor element 27*a* of the thermal head 27 is brought in contact with the surface of the recording paper "A", and the printing apparatus 1 is moved in a direction indicated by an arrow "X" while depressing the print key 20. As a result, the formed document is printed out. In this case, if a user would mistakenly move this printing apparatus 1 in a direction opposite to the normal printing direction "X", a moving block mechanism employed within the printing apparatus 1 is actuated so as to prevent the erroneous printing operation.

CONSTRUCTION OF PRINTING UNIT

Figure 1:
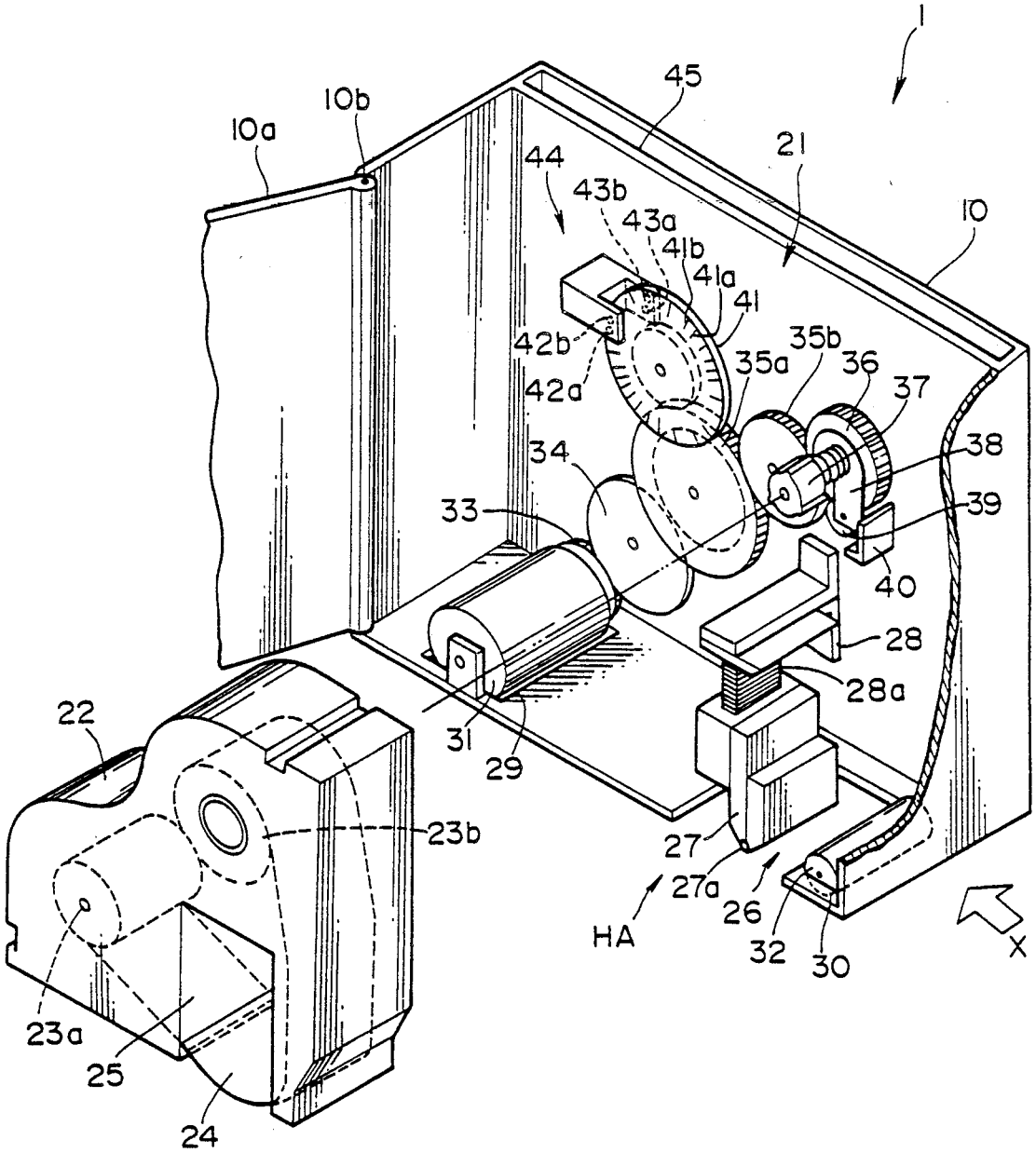
FIG. 1 is a perspective view of a major construction of the printing apparatus according to the invention.

FIG. 1 illustrates a construction of a printing unit 21 arranged within the case 10 shown in FIG. 2. In FIG. 1, reference numeral 22 indicates an ink ribbon cassette. This ink ribbon cassette 22 has such a shape detachably mounted within the case 10 where the above-described printing unit 21 is located in a center thereof. Two ribbon spools 23*a* and 23*b* are mounted on the ink ribbon cassette 22, each of which functions as a feeding spool and a take-up spool for a heat transfer ink ribbon 24. The heat transfer ink ribbon 24 is stored within the ink ribbon cassette 22 in such a manner than one portion of the heat transfer ink ribbon 22 is exposed from a notch 25 for a printer head, which is formed in the lower end portion of the ink ribbon cassette 22.

A printing head mechanism "HA" is constructed by a thermal head 27, a piezoelectric actuator 28*a*, and a head mounting member 28. A cutout 26 for mounting a printer head is formed in the case 10. In a central portion of this cutout 26, the thermal head 27 is positioned in such a manner that the surface side having 20 the heating resistor elements 27*a* are slightly projected from the lower surface of the case 10. The thermal head 27 is coupled by bonding of adhesive, to the piezoelectric actuator 28*a*, which is also bonded to the head mounting member 28. As will be discussed hereinafter, this piezoelectric actuator 28*a* is deformable in itself in response to a supply of alternating voltage. As a result, the thermal head 27 is vibrated in synchronism with deformation of the piezoelectric actuator 28*a*. It should be noted that the above-described piezoelectric actuator 28*a* is manufactured as follows. A powder of a piezoelectric ceramic is dispersed into an organic binder to form a green sheet having a thickness of several tens micrometers, and then a metaline paste is printed on the green sheet, and finally, several hundreds of the printed green sheets are stacked to obtain the resultant piezoelectric actuator. By applying an alternating voltage, the resultant green sheets, i.e., a piezoelectric actuator 28*a*, are deformable in such a manner as performing the movements of expansion and contraction in a stacking direction, in other word, an axial direction thereof. An amount of deformation of the resultant green sheet is about 0.1 to 0.5% of a thickness of the stacking direction.

At the lower side of the case 10, a large opening 29 and a small opening 30 are respectively formed on each side of the cutout 26. Rubber rollers 31 and 32 are mounted on the respective openings 29 and 30. When the printing apparatus 1 is moved in the direction indicated by the arrow "X" during the printing operation, these rubber rollers 31 and 32 rotate in contact with the above-described recording paper "A". A drive gear 33 is coaxially fixed on the side portion of this rubber roller 31. A diameter of this drive gear 33 is smaller than that of the rubber roller 31. This drive gear 33 is meshed with a take-up gear 36 via intermediate gears 34, 35*a* and 35*b*. A ribbon take-up shaft 37 is integrally formed with this take-up gear 36. An arm 38 is pivotally journaled to a base portion of this take-up shaft 37 in such a way that this arm 38 is rotated around a center of this take-up shaft 37. A small gear 39 is mounted at one end of the arm 38. The small gear 39 is meshed with the take-up gear 36, whereby this gear 39 is rotated in the same rotation direction as the above-described gear 36. An arm stopper 40 is mounted in the rotation direction of the arm 38 corresponding to the take-up rotating direction of the take-up shaft 36. That is, when the take-up gear 36 is rotated in the ribbon take-up direction (i.e., a counter-clockwise direction), the arm 38 is rotated to the arm stopper 40 and thus stopped at this position. To the contrary, when the take-up shaft 36 is rotated in the reverse rotation direction (i.e., a clockwise direction), a stopper gear 39 formed on a tip portion of the arm 38 is rotated until it will be meshed with the intermediate gear 35*b*, and then stopped at this position. In other words, a reverse rotation blocking mechanism is constructed in co-operation with above-described gears 35*b*, 36.

On the other hand, an encoder disk 41 is coupled to the intermediate gear 35*a*. The rotation torque of the rubber roller 31 is transmitted to the ribbon takeup shaft 37 and encoder disk 41. A plurality of slits 41*a*, 41*b*, . . . , are formed at a predetermined interval in a radial form on the encoder disk 41. Light emitting diodes (LED) 42*a* and 42*b*, and photosensors 43*a* and 43*b* are arranged at two positions opposite to each other between the successive slit formed portions on the encoder disk 41. In this case, light projected from LEDs 42*a* and 42*b* are incident upon the photosensors 43*a* and 43*b* via the slits 41*a* and 41*b*. With the above-described arrangements, when the encoder disk 41 is rotated in the normal direction by moving the printing apparatus 1 in the X-direction, the light projected from the corresponding LEDs 42*a* and 42*b* are incident upon the photosensors 43*a* and 43*b* in this order. Conversely, when the encoder disk 41 is rotated in the direction opposite to the normal direction, the photosensors 43*b* and 43*a* receive the light projected from LEDs 42*a* and 42*b* in this order. That is, an encoder 44 is constructed of an encoder disk 41, LEDs 42*a*, 42*b*, and photosensors 43*a*, 43*b*. The ink ribbon cassette 22 is detachably fitted to this printing unit 21 in such a manner that the ribbon take-up shaft 37 comes into a supporting axis. The heat transfer ink ribbon 24 which is partially projected from the lower end portion of the ribbon cassette 22, is in contact with the cutout 26 for mounting the head in the case 10. A rear lid 10*a* is hinged on the case 10 by a hinge 10*b* pivotally thereby, whereby an easy replacement of the ink ribbon cassette 22 and an easy maintenance of this printing unit can be achieved. A printed circuit board 45 is inserted between the printing unit 21 and case 10, and connected to the keys and switch groups shown in FIG. 2, and the encoder 44 and thermal head 27 employed in the printing unit 21 shown in FIG. 2.

CIRCUIT ARRANGEMENT

Figure 3:
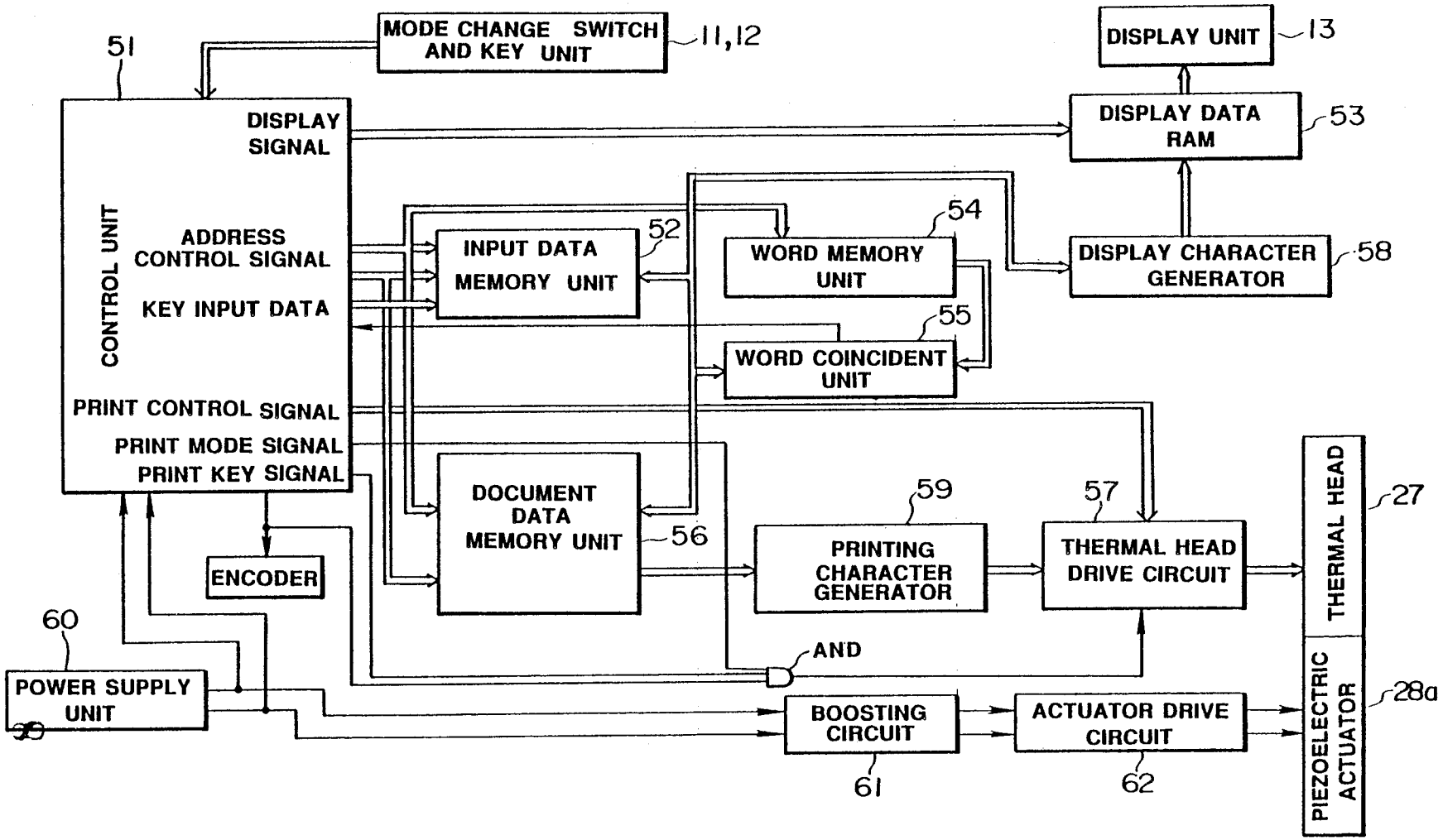
FIG. 3 is a block diagram of an electronic circuit of the printing apparatus shown in FIG. 2.

FIG. 3 shows a circuit arrangement of an electronic circuit formed on the printed circuit board 45.

A control unit 51 is employed to receive the mode changing signal derived from the mode changing switch 11, various key input signal from the key input unit 12, and pulse signals, i.e., a signal for detecting a drive amount of the printing apparatus 10 derived from the encoder 44. In response to the various key operation signals derived from the mode changing switch 11 and key input unit 12, the control unit 51 controls an input data memory unit 52, a display data RAM 53, a document data memory unit 56, and a thermal head drive circuit 57. The input data memory unit 52 successively stores character data such as the alphanumeric characters and symbols entered by operating the character/-symbol input key 14 and function key 15 from the key input unit 12. The character/symbol data input into this input data memory unit 52 are displayed on a display unit 13 via a display character generator 58 and a display data RAM 53. A word memory unit 54 is constructed of ROM (read only memory), where a correct spelling corresponding to each word has been stored. A word coincident unit 55 makes an identification between the word stored in the input data memory unit 52, and another word stored into the word memory unit 54. After the word is input-operated, and then the execution key 15*a* is depressed, the word which has been stored into the input data memory unit 52 is sent to the word coincident unit 55. At the same time, the words stored into the word memory unit 54 are sequentially read out to the word coincident unit 55 under the control of the address of the control unit 51. When a retrieval operation is made in that the word which has been input from the word memory unit 54 and stored in the input data memory unit 52 is coincident with the word, a coincident signal is transferred from the word coincident unit 55 to the control unit 51. This coincident signal has a function to store the word held in the input data memory unit 52 into a predetermined address of the document data memory unit 56. Thereafter, the word held in this input data memory unit 52 is erased. To the contrary, if there is no word having the same spelling as that of the word held in the input data memory unit 52, a miss-spelling display is effected by the control unit 51. Simultaneously, this control unit 51 controls this word to be waited for the registration to the document data memory unit 56. However, as such an operation is no relevant to the present invention, no further description is made in the specification.

The respective character and symbol data of the document data which have been stored in the document data memory unit 56 are output via the display character generator 58 and the display data RAM 53 to the display unit 13, and then displayed thereon. Also, these character/symbol data are output as the actual characters via the printing character generator 58 to the thermal head drive circuit 57. In this thermal head drive circuit 57, the encoder pulses from the encoder 44 are input when the print mode signal is output from the control unit 51. In synchronism with this encoder pulse, the character data which are input via the printing character generator 59 into the thermal head drive circuit 57, are transferred to the thermal head 27 every 1 line. In this case, since the printing quality obtained by the thermal head 27 is, for instance, 24×24 dots (in a full angle), the above-described 1 line is defined by 1/24 line of 1 character.

In the above-described encoder 44, when the encoder pulses from the encoder disk 41 are received by the photosensors 43*a* and 43*b* in this order while the encoder disk 41 is rotated in the normal direction. To the contrary, when the encoder pulses are received by the photosensors 43*b* and 43*a* in this order while the encoder disk 41 is rotated in the reverse direction, no encoder pulse is output. That is to say, if the encoder disk 41 is reversely rotated, the thermal head 27 is not driven even when the printing mode "PR" is set.

To the control unit 51, a power supply voltage is applied from a power supply unit 60. An output voltage derived from this power supply unit 60 is applied via a boosting circuit 61 and an actuator drive circuit 62 to a piezoelectric actuator 28*a* for generating a printing force for the thermal head 27.

PRINTING OPERATION

First, when a desired document is formed, the wordprocessor mode "WP" is designated by operating the mode changing switch 11. Then, the control unit 51 is set to the wordprocessor mode "WP". Under this condition, a user operates the key input unit 12 of the printing apparatus 10 so as to sequentially enter desired characters, symbols and so on.

At the beginning, when the desired document information is key-input by manipulating the character/symbol input key 14 and function key 15, thus the entered input document data are sequentially transferred via the control unit 51 into the input data memory unit 52 which is addressed. Simultaneously, the input document data are supplied via the display character generator 58 and display data RAM 53 to the display unit 13 and displayed thereon. Then, the execution key 15*a* is operated after the desired document is entered, the word which has been stored in the input data memory unit 52 under the above-described controlling operation, is stored into the document data memory 56. When mistakenly entering a word, the cursor key 16 is moved to the word to be corrected, and stopped under this word. Thereafter, a predetermined correction operation such as a correction, addition, and deletion is performed.

A description will now be made on the print out operation of the document data which has been key-input according to the above-described operation. When the document data is printed out, the mode changing switch 11 is selected to the printing mode "PR" position. By operating this mode changing switch 11, the control unit 51 is set to the print mode, whereby the document data memory unit 56 is brought into the readout condition, and the thermal head drive circuit 57 is to wait the input of the encoder pulses from the encoder 44. Under these conditions, as shown in FIG. 1, a user moves the printing apparatus 1 in the direction indicated by the arrow "X" while depressing the print key 20 and the surface of the heating resistor element 27*a* of the thermal head 27 is in contact with the recording paper "A". While the printing apparatus 1 is moved, the rubber rollers 31 and 32 are rotated, and these rotation torques are transferred to the intermediate gears 34, 35*a* and 35*b* as illustrated in FIG. 2. Then, the encoder disk 41 is rotated in accordance with the rotations of this intermediate gear 35*a*. As a result, while the encoder disk 41 is rotated, the light emitted from the respective LEDs 42*a* and 42*b* is transferred and interrupted via the slits 41*a* and 41*b* to the corresponding photosensors 43*a* and 43*b*. In this case, when the printing apparatus 1 is moved in the X-direction, the encoder disk 41 is rotated in the normal condition, so that the pulse signal output from the photosensor 43*a* is an output from the encoder 41. This output signal is sent as a signal for detecting a travel amount of the printing apparatus 1 to the control unit 51 and thermal head drive circuit 57. The rotation torque of the rubber roller 31 is transferred to the take-up gear 36 and ribbon take-up shaft 36. Furthermore, this rotation torque is transferred to the take-up spool 23*b* in the ink ribbon cassette 22. As a result, the ribbon take-up spool 23*b* is rotated thereby to take up the heat transfer ink ribbon 24 which is guided from the ribbon supply spool 23*a* via the cut-out 26 for mounting the head. In this case, the ribbon take-up shaft 37 is rotated, while the printing apparatus 1 is moved, in such a condition that this rotation is in accordance with a travel amount of the printing apparatus not to produce a slip between the recording paper "A" and the ink ribbon 24. Under this condition, the alternating voltage is applied to the piezoelectric actuator 28*a*. Thus, the piezoelectric actuator 28*a* is deformed in the axial direction (in the vertical direction as viewed in FIG. 4). Since the piezoelectric actuator 28*a* is deformed in the axial direction, it follows that the thermal head 27 is vibrated in the axial direction. When the thermal head 27 is displaced in a Y-direction shown in FIG. 4, the ink ribbon 24 is brought in contact with the recording paper "A" at a predetermined pressure load by an action of the thermal head 27.

CHARACTERISTICS OF PIEZOELECTRIC ACTUATOR

FIG. 5A illustrates a characteristic diagram on the time lapse of the alternating voltage which is applied to the piezoelectric actuator 28*a*. FIG. 5B represents another characteristic diagram on the time lapse of the depression force by the thermal head 27 against the recording paper "A" caused by the deformation of the piezoelectric actuator 28*a*. The time dimensions in the horizontal direction shown in FIGS. 5A and 5B are identical to each other. It should be noted that according to the construction of the present invention, if the transfer loss is negligible, the force "F" against the recording paper "A" by the thermal head 27 is identical to the force by the piezoelectric actuator 28*a*. In principle, it is easily understood to describe the force as a stretching force generating in the piezoelectric actuator 28*a*. As a consequence, as to the force "F" in FIG. 5B, the stretching force generating in the piezoelectric actuator 28*a* will be considered.

Referring now to FIGS. 5A and 5B, the stretching force "F" generating in the piezoelectric actuator 28*a* reaches its maximum value "F max" at a point where the voltage "E" applied to the actuator 28 increases from "0". Then, the stretching force "F" becomes "0" at another point just before the apply voltage "E" becomes maximum. During the negative time period of the voltage "E" applied to the piezoelectric actuator 28*a*, the actuator 28*a* contracts. As a result, the stretching force "F" during the negative time period becomes "0". As is apparent from FIG. 5B, an average value "F " of the stretching force "F" generating in the piezoelectric actuator 28*a*, is considerably low, as compared with the maximum value "$F_{MAX}$" of the stretching force "F". By utilizing such a characteristic of the piezoelectric actuator 28*a*, a novel mechanism can be achieved which can satisfy the following trade-off conditions. That is, the printing force is smaller than the weight of the printing apparatus 1, and also the sufficient force capable of heat-transferring the ink layer of the ink ribbon to the recording paper "A".

That is to say, the average value "F " of the stretching force "F" exerted by the piezoelectric actuator 28*a* is set to be lower than the self weight of the printing apparatus 1, and the maximum value "$F_{MAX}$" of the stretching force "F" is set to be higher than the load required for thermally transferring the ink to the recording paper "A". It is, for example, assumed that the weight of the printing apparatus 1 itself is set to be 1 kg and the optimal printing force is selected to be 3 kg or more under which the ink layer melted by the heating resistor element 27*a* of the thermal head 27 is thermally transferred to the recording paper "A". In this case, if the average value "F " of the stretching force is higher than 1 kg and the maximum value "$F_{MAX}$" of the stretching force is equal to, or higher than 3 kg, the printing apparatus 1 is not shortage of the weight, but the sufficient printing pressure can be obtained. In other words, even if the self weight of the printing apparatus 1 is equal to 1 kg, the printing operation can be executed under the condition that no external depression force is loaded to the printing apparatus 1 against the recording paper "A". Namely, the printing operation can be performed completely under the condition only that the printing apparatus 1 is slid over the recording paper "A" with putting the printing apparatus 1 on the recording paper "A". This implies that not only the very easily printing operation can be achieved, but also the mechanical strengths of the various constructions of the printing apparatus are designed to be small since the depression force to be loaded outside the apparatus is practically lowered. Then, similarly, this enables the size of the printing apparatus 1 to be small, and the weight thereof to be light.

Referring back to FIG. 5B, it is apparent that the time period of the alternating voltage to be applied to the piezoelectric actuator 28*a* is needed to have faster than the generating period of the encoder pulse. Since the generating period of the encoder pulse is limited by the printing pulse width applied to the heating resistor element 27*a*, the time period of the alternating voltage applied to piezoelectric actuator 28*a* must correspond therewith. Taking account of the very recent development on the thermal print, the frequencies of the alternating voltage applicable to the piezoelectric actuator 28*a* are selected to be, for instance, several killo-Hertzs to several tens killo-Hertzs.

A description will now be made to the timing relationship between the printing force and the pulse applied to the heating resistor element 27*a*. That is, a more or less time period is required for melting the ink layer under the preparation operation that first, the heating resistor element 27*a* is heated by applying the pulse to this element 27*a*; secondly, the heat energy emitted from the heating resistor element 27*a*; and, finally, the transferred heat energy is stored in the ink layer (not shown in detail) formed over the ink ribbon 24. As a consequence, in FIG. 5B, it is preferable to delay the timing when the piezoelectric actuator 28*a* generates the maximum value "$F_{MAX}$" of the stretching force "F", as compared with the starting timing when the printing pulse is supplied to the heating resistor elements 27*a* formed on the thermal head 27.

Thus, the above-described travel amount detecting signal which is derived as the encoder pulse from the photosensor 43*a*, is transferred as the output signal of the encoder 44 to the control unit 51 and thermal head drive circuit 57. As a result, the control unit 51 sequentially addressing the memory address of the document data memory unit 56 in response to the travel amount detecting signal sent from the encoder 44, whereby the document data stored therein is read out. Then, the readout document data is output via the printing character generator 59, as the individual character data, to the thermal head drive circuit 57. The thermal head drive circuit 57 drives the thermal head 27 in synchronism with the travel amount detecting signal derived from the encoder 44, namely the readout timing of the document data by the control unit 51. The document data is thermally transferred via the ink ribbon 24 to the recording paper "A" while driving the thermal head 27. In this case, while the printing apparatus is traveled, an unused portion of the ink ribbon 24 supplied from the supplying spool 23*a* of the ink ribbon cassette 22 is fed out, and a used portion of the ink ribbon which has been thermally transferred by the thermal head 27, is successively taken up by the take-up spool 23*b*. As described above, while the printing apparatus 1 is moved along the X-direction, the formed document data which have been stored in the document data memory unit 56 are sequentially printed out on the recording paper "A".

MODIFICATIONS

As apparent from the foregoing descriptions, the present invention is not limited to the above-described preferred embodiments, but may be modified without departing from the technical scope of the invention.

In the above-described preferred embodiments, the displacement of the piezoelectric actuator was directly transferred to the thermal head. If, for instance, an amount of displacement of the thermal head becomes shortage, the thermal head may be displaced by employing an enlarging mechanism for enlarging such an amount of displacement of the piezoelectric actuator. Also the ink ribbon was interposed between the thermal head 27 and recording paper "A" in the preferred embodiment. Alternatively, the inventive idea of the present invention may be applied to the following case. That is, a heat sensitive ink layer is formed on the recording paper "A", and the thermal head 27 is directly in contact with this heat sensitive ink layer. The printing apparatus according to the invention may employ a specific heat transfer system. In the specific heat transfer system, a printing head is constructed of an electrode pin and a return-path electrode, instead of the above-described heating resistor element. The heating resistor elements are formed over an entire surface of the recording paper. A power voltage is applied to the electrode pin, so that a current flows through the return-path electrode via the heating resistor elements provided on the recording paper. The heating resistor elements are heated by this current flowing therethrough.

What is claimed is:

1. A printing apparatus comprising:

a thermal head having a large number of heating resistor elements arranged at predetermined pitches thereof;

an ink layer adapted to produce a visible image on a recording paper when said thermal head applies to the ink layer printing force above a threshold value;

an actuator means being deformable to produce motion in synchronism with a control signal supplied thereto;

supporting means for supporting said actuator;

coupling means for coupling said thermal head with said actuator means in such a manner that said motion of said actuator means can be delivered to said thermal head so that said thermal head undergoes vibrations, in response to said motion of said actuator means, which causes a printing force against said recording paper; and means for providing said control signal to control deformation of said actuator means so that an average value of said printing force produced by vibrations of said thermal head is not more than a weight of said printing apparatus, and a maximum value of said printing force is greater than said threshold value.

2. A printing apparatus as claimed in claim 1, wherein said actuator means comprises a piezoelectric ceramic sheet.

3. A printing apparatus as claimed in claim 1, wherein said actuator means comprises a plurality of piezoelectric ceramic sheets.

4. A printing apparatus as claimed in claim 3, wherein said printing apparatus includes a case, and a roller is rotatively mounted to said case, whereby said printing apparatus is manually moved over the recording paper with said roller contacting said recording paper.

5. A printing apparatus as claimed in claim 4, wherein said printing apparatus further includes a heat transfer ink ribbon between said thermal head and said recording paper, and means coupled to said roller for taking up said ink ribbon, said ink layer being carried on said ink ribbon.

6. A printing apparatus as claimed in claim 1, wherein said threshold value of the printing force is higher than the weight of said printing apparatus.

7. A printing apparatus as claimed in claim 4, wherein said recording paper is a thermal sensitive recording paper with said ink layer being fixed to said recording paper.

* * * * *